US005255902A

United States Patent [19]

Coombs

[11] Patent Number: 5,255,902

[45] Date of Patent: Oct. 26, 1993

[54] SORTER WITH SET DISPLACING IN-BIN STAPLER

[75] Inventor: Peter M. Coombs, Tustin, Calif.

[73] Assignee: Gradco (Japan) Ltd., Tokyo, Japan

[21] Appl. No.: 848,489

[22] Filed: Mar. 9, 1992

[51] Int. Cl.[5] ..... B42B 39/02

[52] U.S. Cl. ..... 270/53

[58] Field of Search ..... 270/37, 53

[56] References Cited

FOREIGN PATENT DOCUMENTS 295371 12/1988 Japan ..... 270/53

*Primary Examiner*—Edward K. Look
*Assistant Examiner*—John Ryznic

[57] ABSTRACT

A moving bin sorter has a plurality of sheet receiving trays supported for shifting movement to enlarge the space between adjacent trays at a sheet entry location to facilitate the feeding of successive sheets forming a set of sheets into the successive trays. The trays are formed to allow a portion of a stapler to be moved from a non-stapling position to a position for stapling a set of sheets in the successive trays while displacing the previously stapled sets in their respective trays with another portion of the stapler to enable positioning of the stapler in its operative position to staple a set of sheets. The stapler may be mounted for movement relative to the successive trays for applying staples at more than one location in each set.

11 Claims, 7 Drawing Sheets

SORTER WITH SET DISPLACING IN-BIN STAPLER

BACKGROUND OF THE INVENTION

The present invention relates to sheet sorters, collators or receivers having a plurality of receiving trays into which successive sheets are fed from a copier, printer or the like source of printed sheets to be collated and assembled or finished in integrated sets by means of an in-bin stapler or finished operable for movement between an out of the way position permitting the feeding of sheets into the receiving trays and an operative position for in situ finishing or stapling of the collated sets, prior to removal of the sets from the trays.

The problems of stapling in combination with collating sets of sheets differ, depending upon the nature of the collator. For example, when the collating trays are disposed in fixed stacks, spaced vertically to receive a selected number of sheets in sets in the trays, it is a relatively simple task to mechanically remove sets of sheets from the trays and transport the sets to a stapling station or finishing station or to move the trays from a sheet receiving position to a sheet stapling or finishing position at which the sets are bound.

In recent years, collating or sheet sorting machines have been developed for use in conjunction with reproducing machines i.e., photocopying or printing machines, wherein the collators or sorters are of a compact configuration, having trays which are mounted so as to be shifted from positions above and below a sheet entry location at which sheets are fed from the reproducing machine, or at the discharge location of a sheet transport, at which the trays are spaced relatively far apart to facilitate entry of a desired number of sheets. At the positions above and below the sheet entry location, the trays may be close together and can compact the sheets into a reasonably tight set.

These moving bin sorters or collators provide limited space for the purpose of installing a stapler, and the closely spaced relationship of the trays, in all but the sheet receiving position, renders difficult application to the structure of an automatic stapler for in-tray stapling of the sets.

Prior devices have been developed, however, for in-tray stapling of collated sets, in a number of ways. Typical moving tray sorters have the trays extended upwardly on an incline in the direction of sheet movement into the trays and the trays are actuated by a suitable cam to vertically move the ends of the trays proximate the sheet entry between positions below the sheet entry to above the sheet entry so that the height of the space between trays at the sheet entry location is determined by the profile of the cam.

U.S. Pat. No. 4,928,941, granted May 29, 1991, to Nobutaka Uto, et al discloses one example of a sorter combined with a stapler which is shiftable from a position out of the path of sheets entering a tray to a position at which the anvil of the stapler is moved to a position below the set of sheets and the stapler body occupies space caused by the inherent longitudinal displacement of the trays above the sheet receiving tray, as the inclined tray moves from below to above the sheet entry location. The longitudinal displacement of the superposed trays provides space for the stapler body, even though the trays are not sufficiently vertically spaced to provide space for the stapler body. Such a construction requires adequate longitudinal displacement of the trays above the tray in which stapling is performed to assure adequate margin for stapling.

U.S. Pat. Nos. 4,687,191, granted to Stemmle and 4,681,310, granted to Cooper, disclose moving tray sorters of the type wherein the trays are spaced apart to receive sheets and are close together above and below the sheet entry location. In these prior devices, the tray shifting or indexing means are constructed to cause the trays to provide a space or spaces in addition to the normal sheet receiving spacing of the trays, whereby the stapler may be moved from a position clearing the paper path at the sheet inlet to a position at which the anvil and body of the stapler are accommodated by the additional spaces between trays.

On the other hand, the need for providing space for the stapler may be obviated in the case that the tray may be shifted to the stapler, as seen, for example, in Kramer et al U.S. Pat. No. 4,925,171, but such structure is large and not generally applicable to today's type of small sorters. As indicated above, the mode of operation can be accomplished simply in the case of such vertically spaced and fixed trays which can be translated horizontally to or from a stapler.

Also, it is known to use certain tray shifting cam mechanisms, having dual cams and guides which direct the course of the tray ends proximate the sheet inlet location, so that the trays are moved horizontally, opposite to the direction of sheet infeed into the stapler throat between the anvil and the body of a fixed stapler which is not restrained in its application to a set of sheets by the path of sheets into the trays during normal sorting or collating of the sheets.

In all of these set stapling or binding operations, there is a problem of stapling efficiency if the set of sheets is not in a compact and neat order during staple penetration when the stapler is activated. Transfer devices which grip the set of sheets, transfer the set to an out of the way stapler and deposit the sets in a receptacle, as seen in Noto U.S. Pat. No. 4,361,393, for example, are quite efficient due to the clamping action of the transfer device on the sets. However, such machines, usually referred to as finishers, either in association with a collator on a reproduction machine or used for off-line collating, are large and expensive, and do not lend themselves to advantageous use in conjunction with typical, small compact sorters used in combination with photocopying machines, such as the sorter disclosed in Lawrence U.S. Pat. No. 4,911,424, or other compact sorters such as that shown in Lawrence U.S. Pat. No. 4,343,463, or DuBois and Hamma U.S. Pat. No. 4,328,963 as examples of sorters of the type with which the present invention is concerned.

In Lawrence U.S. application Ser. No. 730,746 filed Jul. 16, 1991, of common ownership herewith, there is disclosed an apparatus which, in a moving tray sorter, grips collated sets in the trays and partially backs the sets out of the trays in the opposite direction from the infeed direction, transfers the trailing edge of the set to a stapler and then returns the stapled set to the trays successively. The gripper and the stapler are arranged so as to not interfere with the sheet infeed.

In Morii, et al, U.S. Pat. No. 4,971,302, there is shown an example of set gripping and partial removal from a side of the tray, not the infeed end of the tray, and returned to the trays by gripping and stapling means disposed off to one side of the trays and occupying a large space at the side of the sorter.

SUMMARY OF THE INVENTION

The present invention provides a more simple collator or sorter with in-bin stapling capacity which obviates use of the complicated prior art structures and devices for shifting bins or sets relative to the stapler or mounting the stapler in undesirable locations for movement towards the bins, and which is ideally suited for use in combination with sorters of the type shown, for example, in U.S. Pat. No. 4,911,424 or U.S. Pat. No. 4,328,963 or with other moving bin sorters of the general type wherein trays are cammed apart to increase space for entry of sheets at an sheet entry location, such as for example, the moving bin opened sorters of DuBois U.S. Pat. No. 4,478,406.

More particularly, the present invention involves association of the stapler with the sheet infeed means which delivers sheets to the trays at the sheet inlet location formed by the tray shifting cams, so that sheets may be fed into the trays while the stapler is in an inoperative location, and, when the sets are to be stapled the stapler is shifted to a stapling position, in such a way as to displace previously stapled sets longitudinally of the tray with either the stapler body, while the stapler anvil extends into the enlarged space provided between trays at the sheet entry location, or displacing previously stapled sets with the stapler anvil during the stapling operations.

With such a construction, no provision need be made for additional space for the stapler between the tray in which stapling is being performed and the trays thereabove. Accordingly, the overall height of the apparatus, for any particular configuration may be minimized while, at the same time, positioning of the stapler in its operative position is simplified.

The stapling may be performed at one corner of the set, or the stapler may be shifted transversely of the sorter for applying multiple staples.

DETAILED DESCRIPTION

Figure 1:
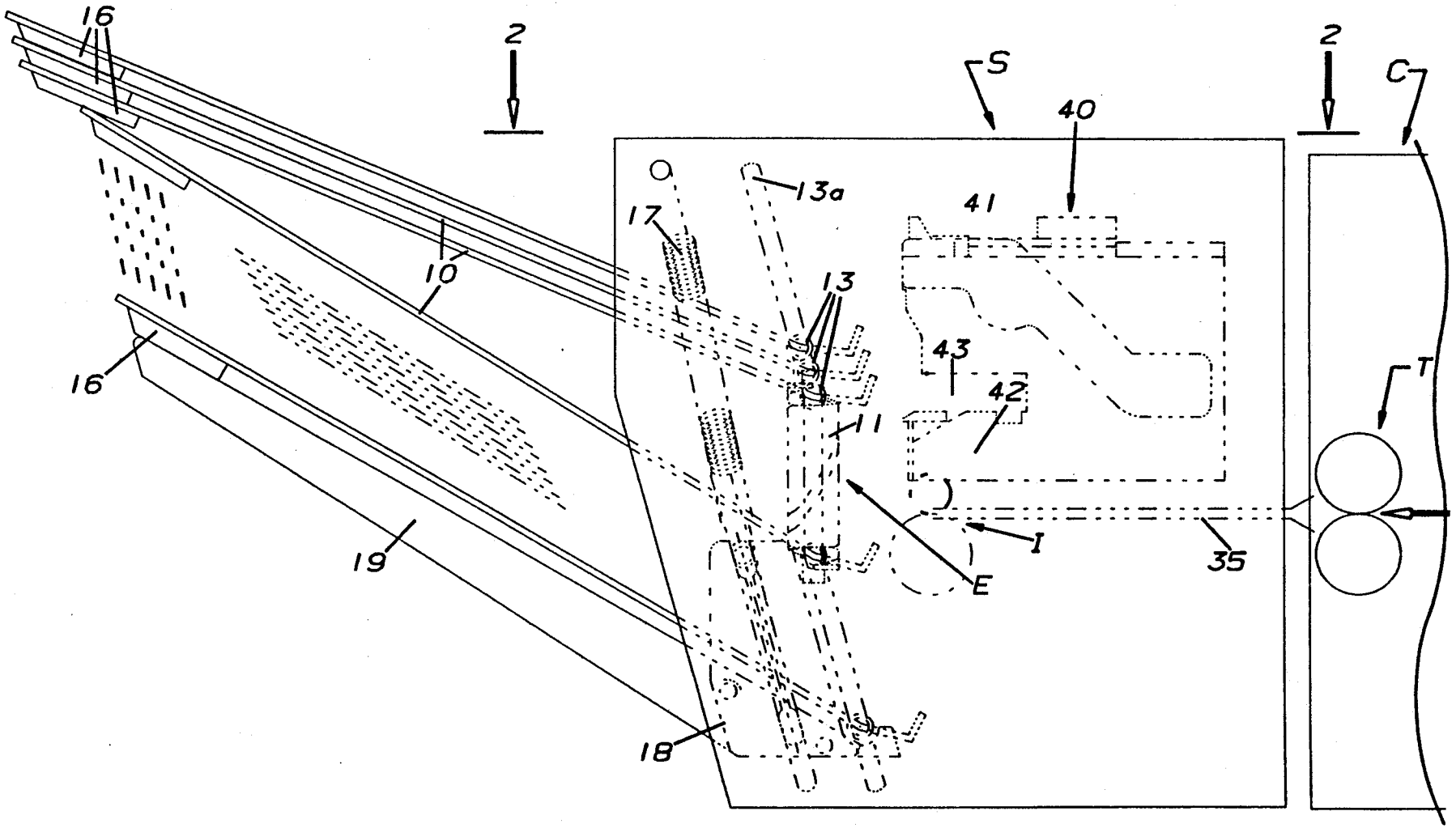
FIG. 1 is a side elevation generally illustrating a sorting machine in accordance with the invention applied to a copier or printer.

As seen in the drawings, a collator or sorter S is shown in association with a copier or printer C adapted to supply printed sheets from a transport T which supplies sheets as indicated by the arrow in FIG. 1.

The sorter as illustrated, may have various constructions but, such as that disclosed in U.S. Pat. Nos. 4,911,424, 4,328,963 or 4,478,406 referred to above, or Kitayama U.S. Pat. No. 4,941,657, and to which reference may be made for the sorter details.

The sorter is adapted to sequentially vertically shift a number of trays 10 between positions above a sheet entry location E and positions below the sheet entry location, during sheet sorting operations. The bin shifting means shown is like that disclosed in U.S. Pat. No. 4,911,424. A pair of rotary bin shifting members 11 are disposed at opposite sides of a frame structure 12 and engage trunnions 13 which project laterally from opposite sides of the trays 10 at their inner ends through vertically extended guide slots 13*a*.

As shown, shifters 11 may be spiral cams rotatable with shafts 14 at opposite sides of the bins and adapted to be rotated in opposite directions by a reversible electric motor M and timing chains or belts 15 to shift the bins sequentially and allow sheet entry into the selected bins. A control systems for the motor is shown, for example, in U.S. Pat. No. 4,343,463, in FIG. 13, incorporated herein by this reference.

It will be understood that as the trays are shifted, the trunnions of adjacent trays will be spaced apart by the cams 11 to provide a wide sheet entry, in the infeed location E. In addition, the outer or distal ends of the trays are supported for pivotal movement on tray ends 16, to open the outer ends of the trays and facilitate entry of sheets, particularly long sheets which extend beyond the outer ends of the trays. However, in some forms of the invention (not shown) the tray ends 16 may pivot on sliding surfaces in a frame structure or the tray ends may be caused to move vertically in unison, as disclosed, respectively, in the above mentioned Nobutoka et al U.S. Pat. No. 4,928,941 and Lawrence U.S. Pat. No. 4,911,424 in the present embodiment.

The inner ends of the trays, at the sheet entry location E are biased upwardly by a spring 17 into engagement with the cams 11 or, in some forms of the invention, the upward bias may be provided mechanically as disclosed in the aforementioned Lawrence U.S. Pat. No. 4,911,424, without requiring illustration herein for an understanding of such a trunnion and cam structure. More particularly, as herein shown, the spring 17 applies an upward force on support brackets 18 at opposite sides of the frame structure. Extended outwardly from the brackets in a upwardly inclined support plate 19 which engages beneath the outer end 16 of the lowermost tray. Brackets 18 are mounted for vertical movement by suitable means, and has a pin and slot connection 18*a* with the frame structure, so that the spring 17 constantly applies an upward force to the brackets 18 and the support plate 19 to lift the support plate and, therefore, the trays 10 to cause the trunnions 13 of the trays below the cams to move upwardly into engagement with the cams 11 and support the outer tray ends as the cams move the trays vertically in parallel relation. Thus, each succesive tray is in the same disposition for stapling during the stapling operations. This arrangement of the lift plate also causes the trunnions on the lowermost tray to be engaged by the cams so that the lowermost tray will be raised to a stapling position. If desired, the lift plate may be formed to receive sheets which are not to be stapled.

The sorter shown has an infeed means I, comprising a driven shaft 30, having resilient feed rolls 31 thereon, driven by a motor M2 in a suitable manner. Above the driven shaft 30 is a pinch roll shaft 33 having pinch rolls 34, whereby sheets are positively driven into the bin trays. A sheet guide 35 extends from the rolls 33, 34 towards the copier transport T to bridge the gap between the transport T and the infeed I.

Associated with the infeed means I is a stapler 40 of a known type, such as the "Max" stapler of Max Co., Ltd. It has a body section 41 and an anvil 42 forming a throat 43 adapted to receive a set of documents or sheets to be stapled. Such staplers carry a supply of staples in the body and have an electrically operated hammer to force staples into and through the set of sheets against the anvil, as is well known.

Figure 2:
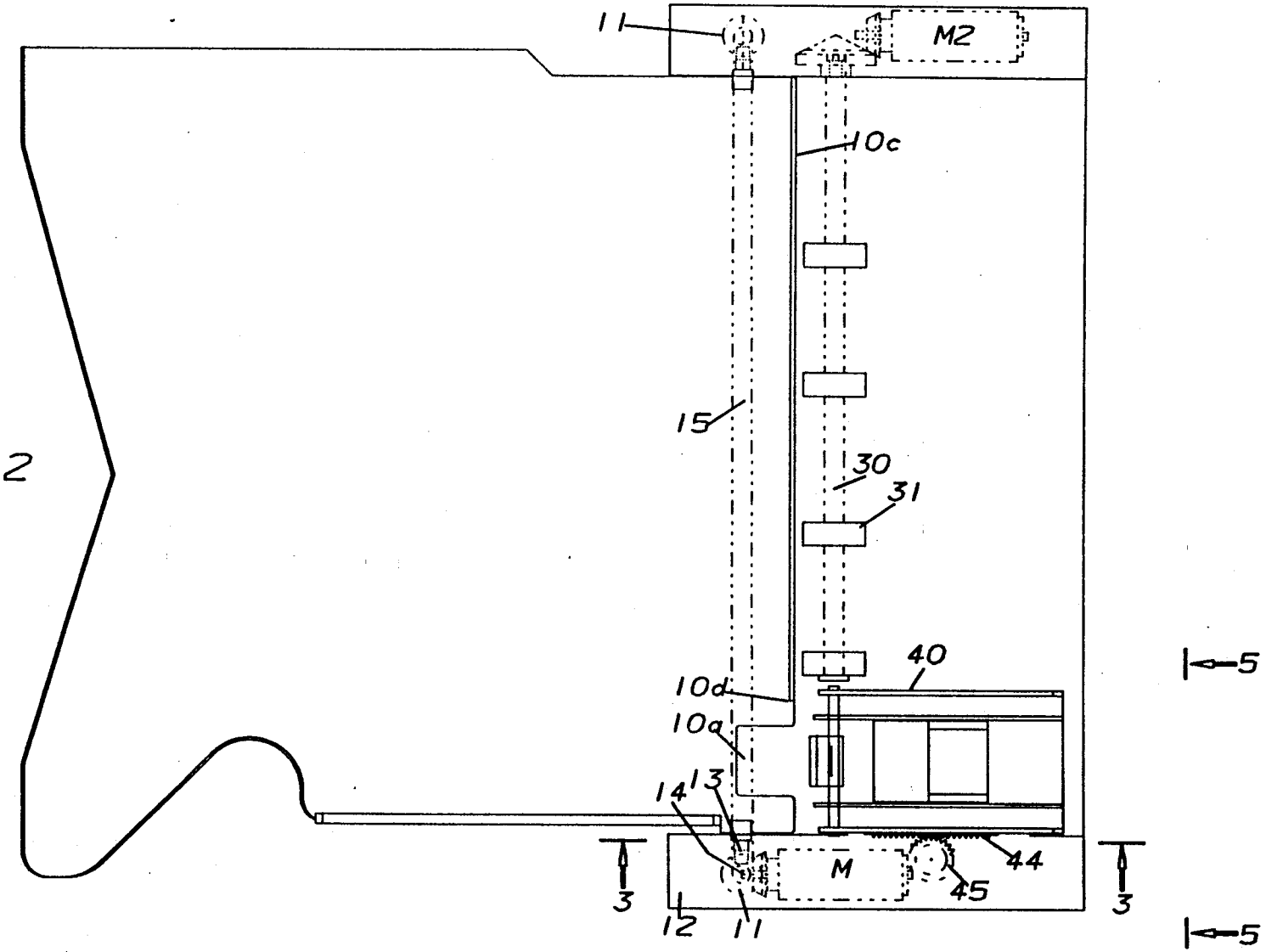
FIG. 2 is a horizontal section as taken on the line 2—2 of FIG. 1 with the top of the housing removed.
Figure 3:
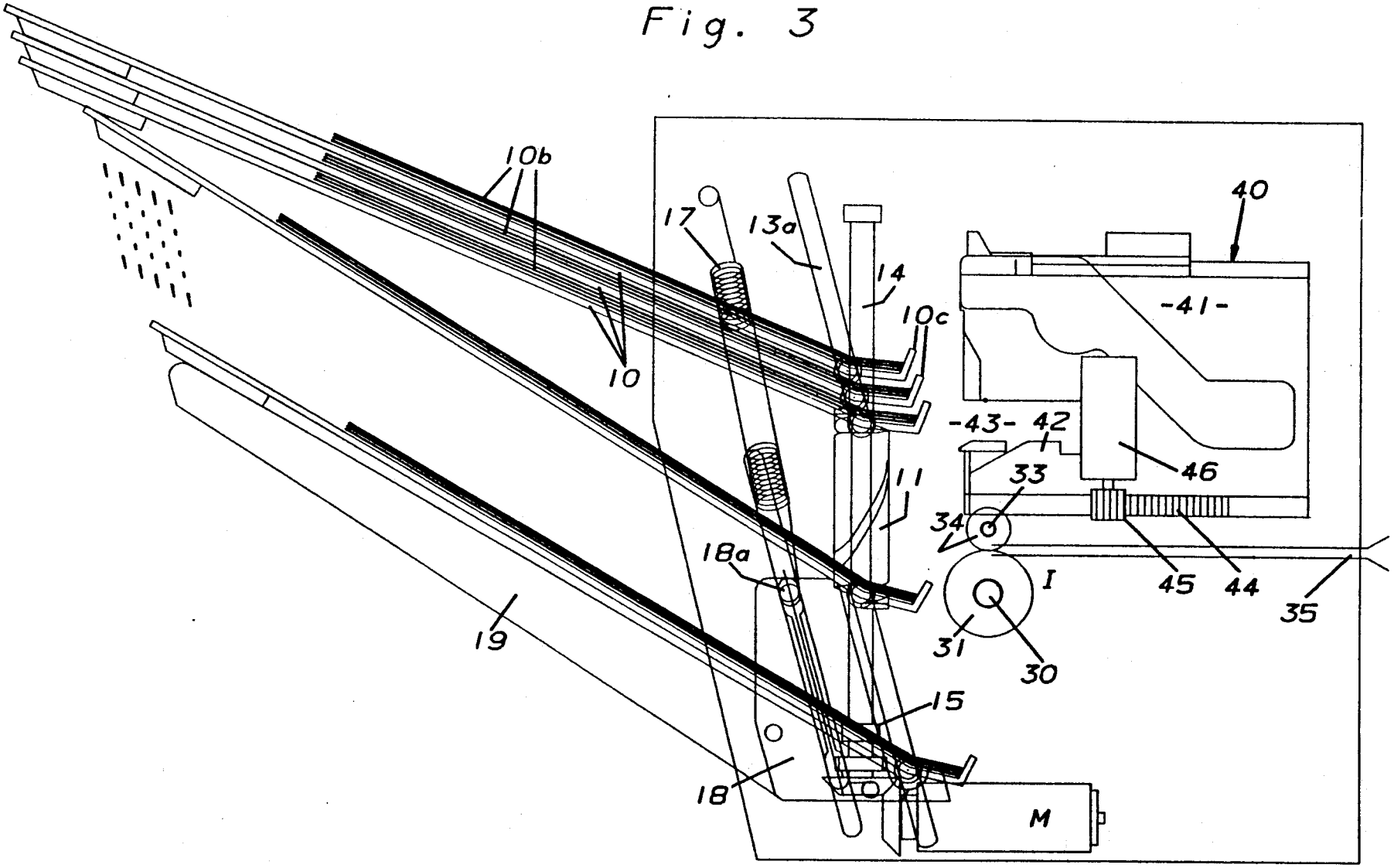
FIG. 3 is a fragmentary vertical section on the line 3—3 of FIG. 2 with the apparatus in sorting condition.
Figure 4:
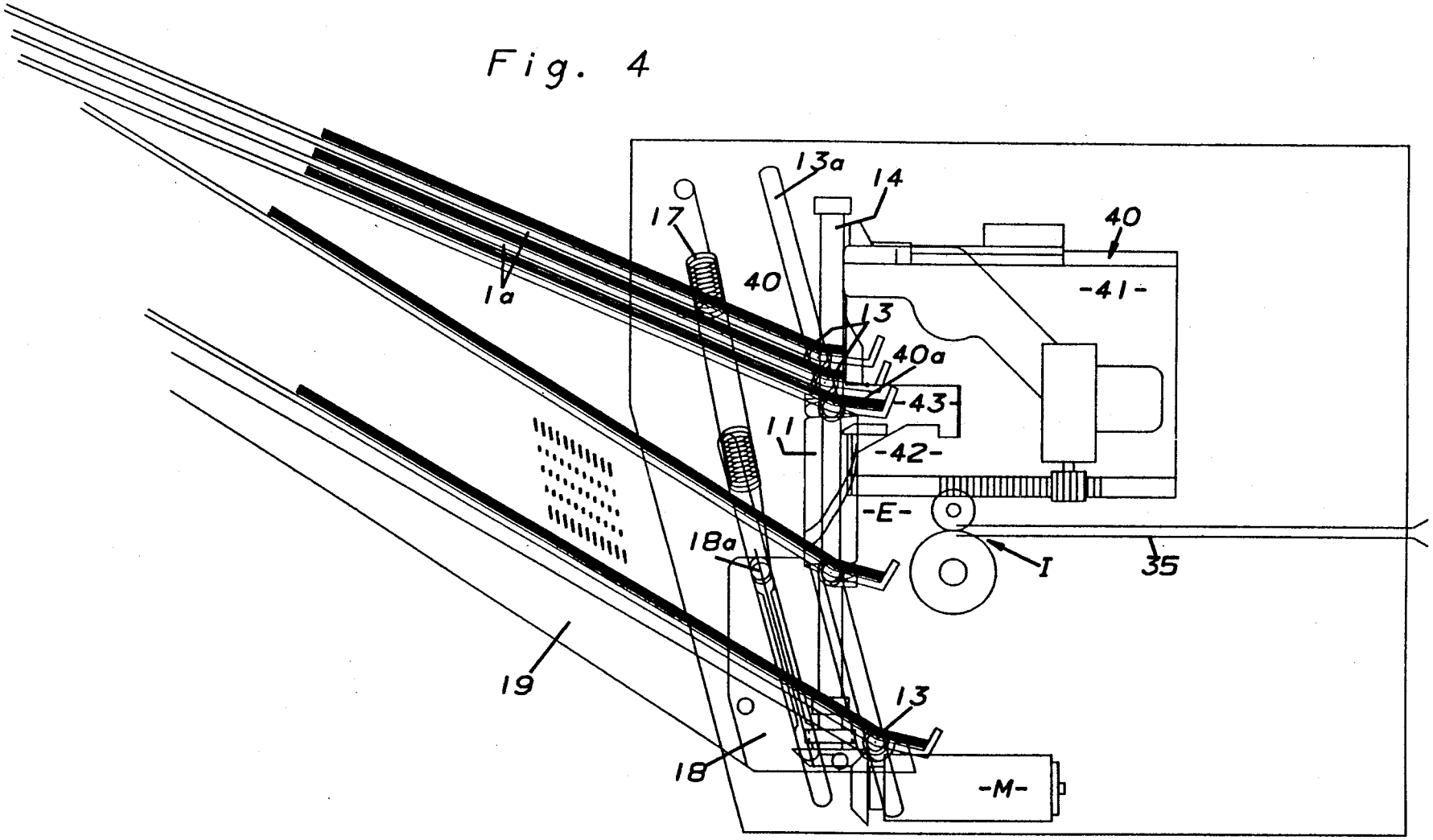
FIG. 4 is a view corresponding to FIG. 3, but showing the stapler in position to staple a set of sheets and showing a number of previously stapled sets displaced longitudinally of the respective trays above by the stapler.
Figure 6:
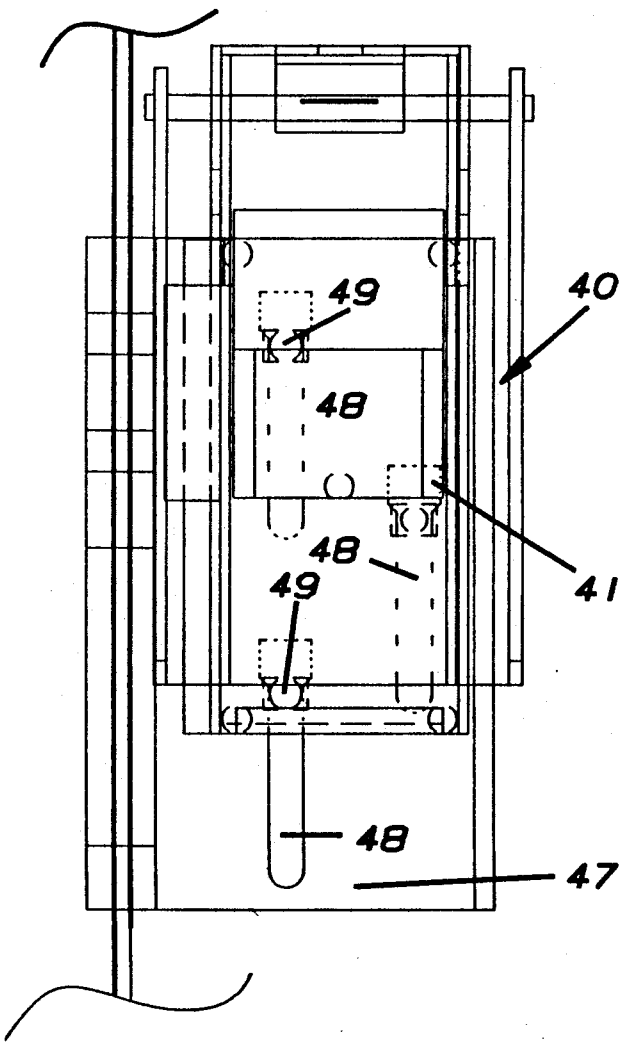
FIG. 6 is a view on the line 6—6 of FIG. 5, showing the top of the stapler.
Figure 5:
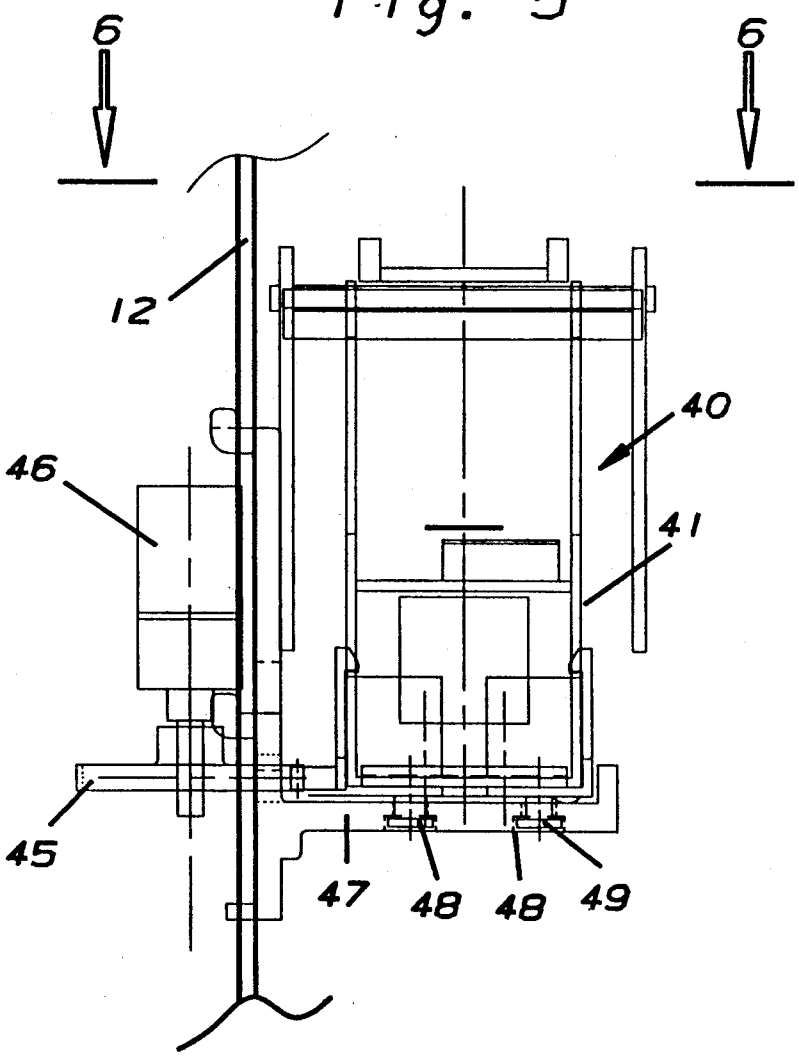
FIG. 5 is an enlarged detail on the line 5—5 of FIG. 2 showing the stapler and shifting mechanism.

Means are provided to shift stapler 40 relative to the infeed means between the retracted or non-stapling position of FIG. 3 and the stapling position of FIG. 4. The stapler shifting means, as shown in FIGS. 1–6, includes a rack 44 and pinion 45 driven by a reversible motor 46. As seen in FIGS. 5 and 6, the stapler body 41 is mounted for horizontal sliding movement on a base plate 47 mounted in frame 12 by means of a number of elongated slots 48 receiving guide pins 49.

As seen in FIG. 2, the trays are provided with clearance space by a notch or cut-out 10*a* at one corner, so that as the stapler is moved to a stapling position, the corner of a set of sheets is exposed in space 10*a* to be disposed in the throat of the stapler for the application of a staple.

Referring to FIGS. 3 and 4, it will be seen that, in operation to sort sheets the trunnions 13, in this case, also abut with one another above and below the cams and define a small space between the trays. The cams 11 space the trays above and below the cam to provide the large sheet entry space E into which the infeed rolls feed the paper sheets during collating operations. During collation of sets of sheets the cams are operated to sequentially shift the trays at their sheet inlet ends upwardly and downwardly as each series of new sheets is fed into the sorter to form sets of sheets indicated at 10*b*.

When it is desired that the sets be stapled all of the trays 10 are moved to their lower position below the cams 11. Sets 10*b* are aligned against an upturned flange 10*c* at the inlet end of each tray. Each flange 10*c* terminates at 10*d* (FIG. 2) so that the stapler body 41 is free to move horizontally over the inner end of the tray to enable a staple to be inserted. The shifting means 44, 45, shifts the stapler from the retracted position of FIG. 3 to the stapling position of FIG. 4 to apply a staple 40*a*. As the stapler moves into position to receive a set in the tray above the cams in the stapler throat, the anvil portion 42 of the stapler extends into the enlarged space between the trays above and below the cams. The sets 10*b*, however, in all trays above the top end of the cams, are engaged by the body 41 of the stapler as it moves into stapling position at the cut out portion 10*a* of the upper trays. This causes the sets of sheets in the upper trays to be longitudinally displaced to the extent that the stapler body longitudinally overlaps the sheet entry ends of the trays. The extent of such overlap and the number of sets displaced depends on the angle of the guide slots for the trunnions. If the slots are truly vertical, then the displacement of sets will occur uniformly in more trays than when the slot is inclined, as shown. However, the inclined trunnions guide slots 13*a* cause offsetting of the sets in the upper trays a distance horizontally of the trays depending on the angle of the slots from vertical.

Briefly, in the operation of the sorter as thus far described, the sorter trays are cycled upwardly and downwardly successively to receive the sheets from the source copier or printer in a selected number of collated sets. The cams are then actuated to move all trays containing sets downwardly, with the stapler retracted, to a position below the stapler. Then, the cams are actuated to sequentially move the trays upwardly to a stapling position at which the enlarged space is provided by the cams and, at which the stapler is shifted to the stapling position and a staple indicated at 40*a* is applied to the set of sheets. The stapler is retracted as the next tray moves upwardly and, then, returned to the stapling position, and so on, until all sets are stapled. In each instance previously stapled sets in the trays above the stapler throat are longitudinally displaced in the respective trays upon engagement by the stapler body, as seen in FIG. 4.

If desired suitable jogging means may be employed to move the sheets into neat sets with their edges aligned.

Figure 8:
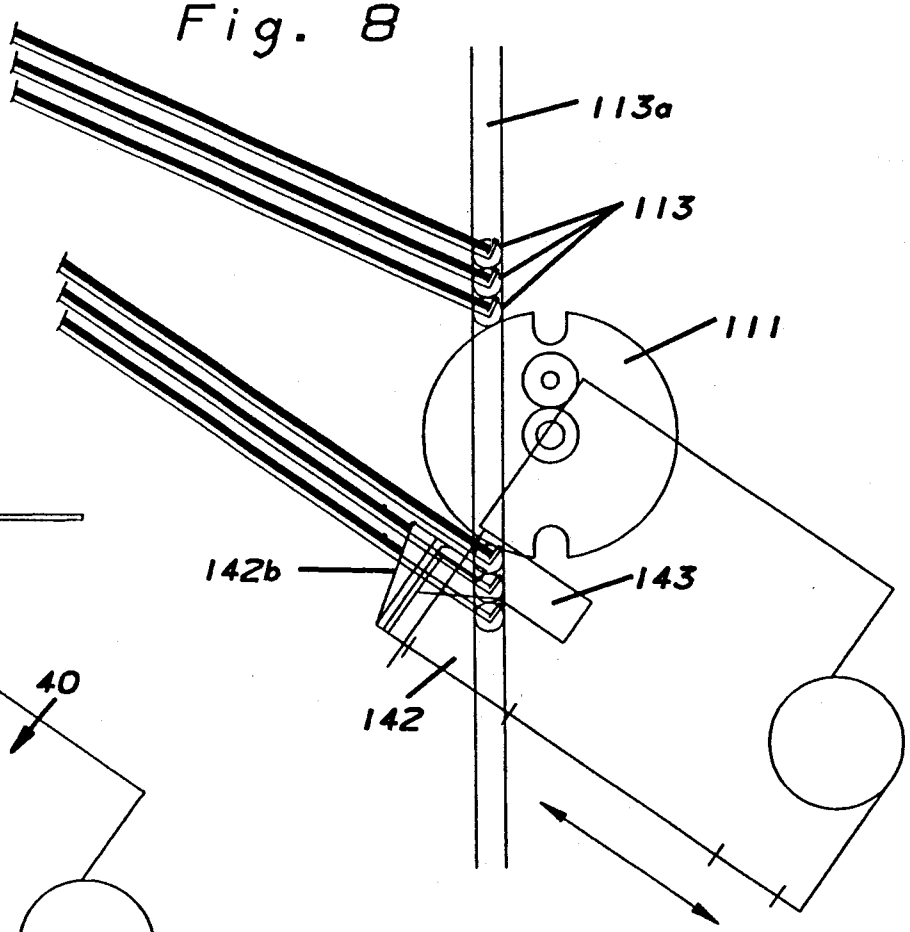
FIG. 8 is a view corresponding to FIG. 7 showing the stapler in operative position and displacing previously stapled sets in the trays below.
Figure 7:
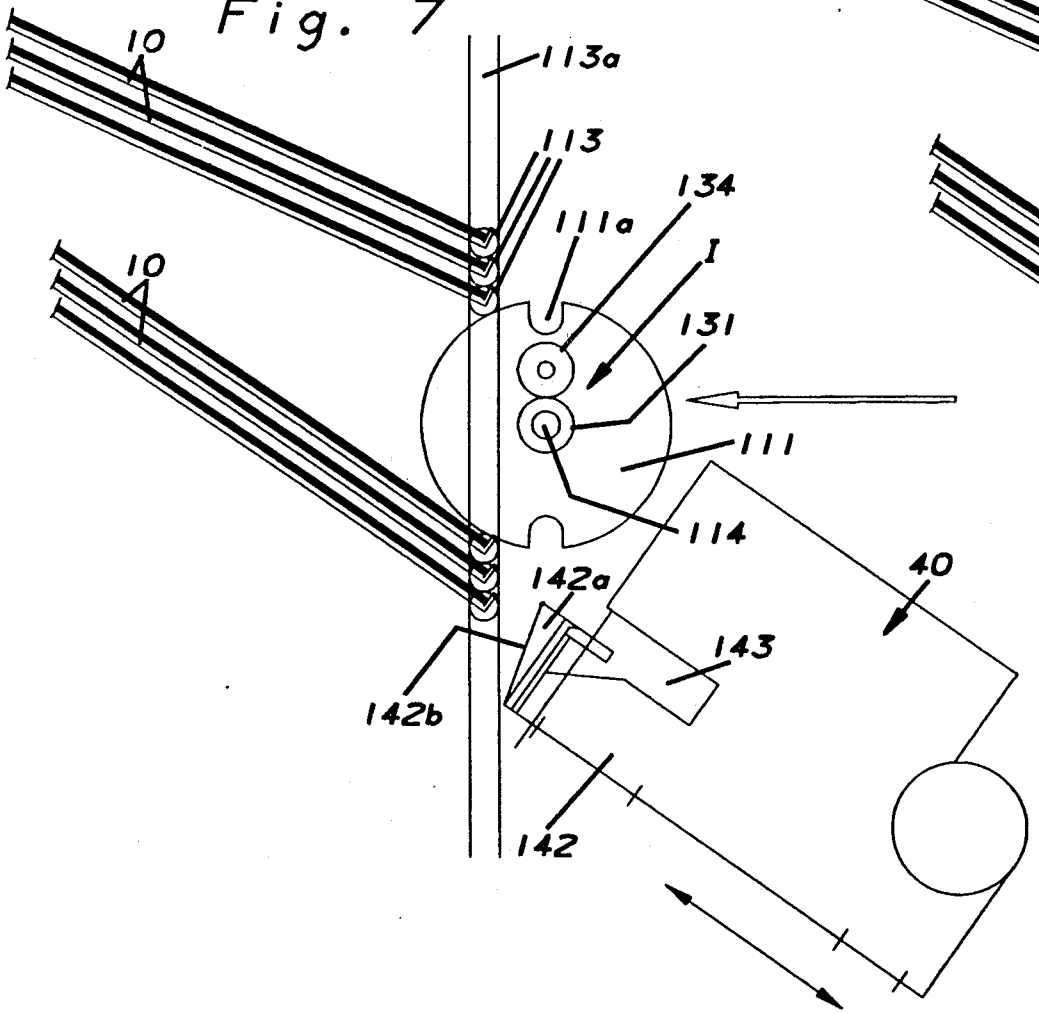
FIG. 7 is a fragmentary vertical section illustrating a modified form of sorter and stapler arrangement, with the apparatus in the sorting condition.

As seen in FIGS. 7 and 8, a modified construction may incorporate the invention, wherein the previously stapled sets in the trays below the tray in which stapling is performed are displaced during subsequent stapling operations, so that stapling may be performed in both the upward and downward movement of the trays by the tray shifting means. In the form illustrated and described, stapling is being performed in the downward movement of the trays.

In this form the sorter again has the plurality of upwardly inclined trays 10 adapted to receive sets of sheets supplied to the infeed means I, having driven infeed rolls 131 and nip rolls 134. However, in this form, the cam means 111 is in the form of a pair of geneva type cam wheels rotable with a cam shaft 114. This type of sorter construction, without requiring specific illustration herein, is more particularly like that disclosed in DuBois and Hamma U.S. Pat. No. 4,466,608 to which reference is incorporated herein, but it will be understood that a lift plate and spring would be employed, as in the prevously described embodiment to cause conformity of tray disposition during stapling operations. In this construction the trunnions 113 are vertically movable in vertically elongated slots 113*a* in the frame structure upon half revolution of the cam wheels 111 which have radial notches 111*a* adapted to engage the trunnions 113 and transfer them in the slots 113*a*, depending upon the direction of rotation, to sequentially move the ends of the trays at the enlarged sheet entry space E to positions above and below the infeed means I.

The stapler means 40 in this embodiment is disposed at an angle corresponding to the angle at which the trays are disposed, and as indicated by the arrow, the stapler is reciprocable between the non-stapling position of FIG. 7 and the stapling position of FIG. 8. In the stapling position seen in FIG. 8 it will be noted that the anvil portion 142 of the stapler displaces the sets of sheets in the trays below the tray in which the stapling operation is performed in the throat 143 of the stapler. In addition, in this illustrative embodiment, there is illustrated a set displacing member 142*a* on the anvil portion for engagement with the sets of sheets, this portion 142 having a set contacting face 142*b*, so that the sets which have been stapled are offset longitudinally. In the embodiment illustrated in FIGS. 1-6, from the above description of the offsetting of the sets, it will be recognized that in the first described embodiment the vertical face of the stapler body also offsets the sets of sheets following the stapling operations.

Figure 9:
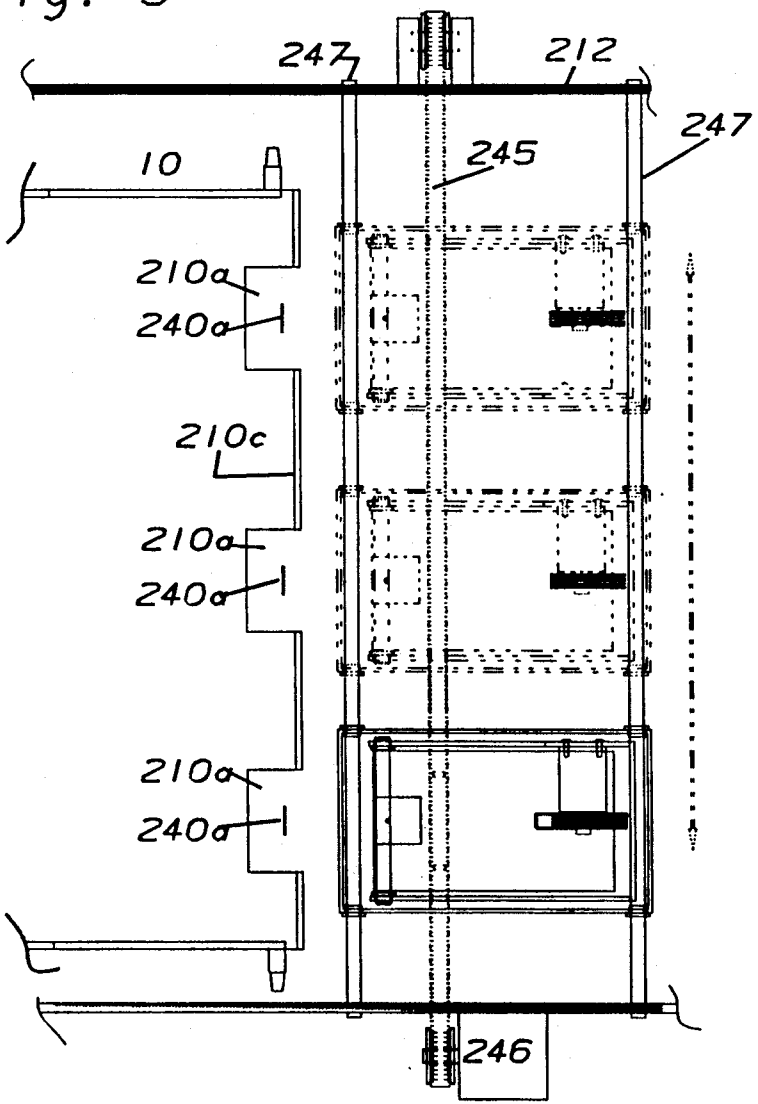
FIG. 9 is a fragmentary horizontal section illustrating a stapler shifting mechanism for moving the stapler horizontally for stitching the sets of sheets.

Referring now to FIG. 9 another embodiment of the invention is illustrated which enables the stapling of the sets of sheets in a plurality of locations spaced horizontally of the trays. In this form the trays 10 are notched as at 210*a* at a plurality of laterally spaced locations so that the stapler may be shifted to a stapling position in each of these space locations and end flange 210*c* of the tray also has clearance spaces allowing movement of the stapler to the stapling position.

Here the stapler is not only mounted on the frame structure for movement between the stapling and non-stapling position as previously described but the stapler is also supported on horizontally extended rods 247 which span the frame structure 212. The stapler body is connected to drive means 245, simply illustrated as a belt adapted to be driven in opposite directions by a reversible drive motor 246 so as to be selectively positioned either in the full line position of FIG. 9 or at either or both of the dotted line positions shown in FIG. 9. This enables a staple to be inserted as indicated at 240*a* at either corner of the set, at both corners of the set or at the corners and at the middle of the set. In this way the stapler can be positioned to place a staple in the appropriate corner of the sets, depending upon the way in which the sheets are disposed in the sorter trays, i.e., either long edge or short edge at the lower ends of the trays, as is well known in the art.

Figure 10:
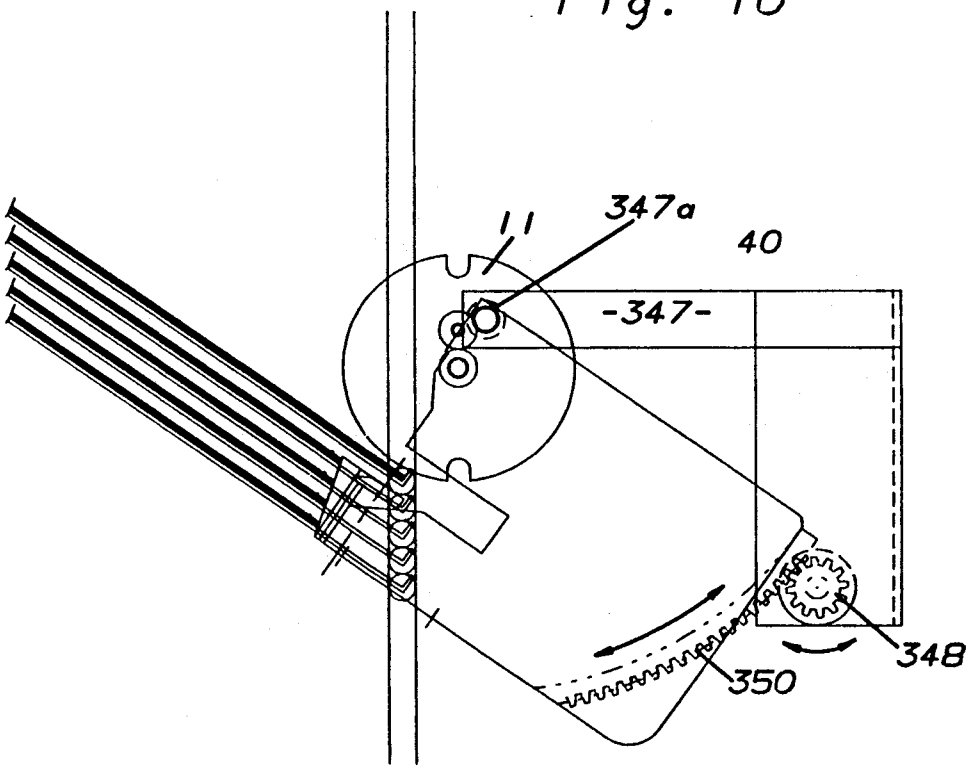
FIG. 10 is a fragmentary vertical section illustrating a modified means for shifting the stapler in FIG. 9 in an arc between stapling and non-stapling positions.

In FIG. 10 there is illustrated a mechanism for not only enabling the stapler to be transversely shifted, as in the case of the stapler of FIG. 9, but also enabling the stapler to be inclined like the stapler in FIGS. 7 and 8 during stapling operations. For this purpose the stapler is pivotally mounted on a transversely extended pivot support 347. The stapler is adapted to be moved horizontally by rotation of a screw 347*a* engaged in the support 347 to the several stapling positions. At any of these positions drive pinion 348 is operable to drive rack 350 to swing the stapler body on the support 347 to cause pivotal movement of the stapler body to and from the stapling position depending upon the direction of the rotation.

From the foregoing, it will now be recognized that the invention provides a simple and efficient adaptation of existing sorters to provide in-bin stapling by reason of the fact that the structure contemplates displacement of sets of sheets to provide access for the stapler, without requiring the provision of space between trays other than the customary enlarged space into which sheets are fed during sorting operation in cam operated sorters in which the trays are opened during sorting operations, and that normally enlarged space accommodates a portion of the stapler, while another portion of the stapler displaces the sets of sheets in other trays, so that the sets being stapled have access to the throat of the stapler.

I claim:

1. A sheet receiver of the moving tray type with an in-bin stapler, comprising: a frame structure, a plurality of horizontally extended trays arranged in a vertical stack in said frame structure, cam means for vertically sequentially displacing ends of said trays adjacent a sheet entry location to provide an enlarged sheet entry space between an adjacent pair of trays, means for sequentially operating said cam means in opposite directions as sheets are fed into the sheet entry space to form sets of sheets in said trays, a stapler having hammer and anvil portions forming a throat to receive an edge portion of a set of sheets in said trays, means for shifting said stapler towards and away from said trays for selectively positioning said sets of sheets in said throat for application of a staple, with one of said portions of said stapler extending into said enlarged space and the other of said portions of said stapler engaged with and displacing a set of sheets in a tray vertically spaced from said enlarged space.

2. A sheet receiver as defined in claim 1, wherein said stapler anvil portion extends into said enlarged space, and said stapler hammer portion displace a set of sheets in the tray above said stapler throat.

3. A sheet receiver as defined in claim 1, wherein said stapler hammer portion extends into said enlarged space, and said stapler anvil portion displaces a set of sheets in the tray below said stapler throat.

4. A stapler as defined in claim 1, including means for horizontally shifting said stapler between a plurality of horizontally spaced stapling positions.

5. A sheet receiver as defined in claim 1 including infeed means for feeding sheets into said trays at said enlarged sheet entry space, said stapler being shiftable relative to said infeed means from a retracted position allowing sheets to be fed into said trays by said infeed means to a position at which sheets are disposed in the throat of said stapler.

6. A sheet receiver as defined in claim 1 including infeed means for feeding sheets into said trays at said enlarged sheet entry space, said stapler being shiftable relative to said infeed means from a retracted position allowing sheets to be fed into said trays by said infeed means to a position at which sheets are disposed in the throat of said stapler, and including means for horizontally shifting said stapler relative to said infeed means between a plurality of horizontally spaced stapling positions.

7. A sheet receiver as defined in claim 1, wherein said trays extend upwardly at an incline from said enlarged sheet entry space, and said portion of said stapler which displaces a set of sheets displaces a plurality of sets of sheets in a plurality of trays, said portion of said stapler which displaces said sets having a substantially vertically extended set displacing surface whereby stapled sets displaced by said stapler have their ends remote from the stapler offset to facilitate removal of stapled sets from said trays at the ends thereof remote from said enlarged sheet entry space.

8. A sheet receiver as defined in claim 1, wherein said trays extend upwardly at an incline from ends at said enlarged sheet entry space, said ends of said trays having an upturned wall forming a stop against which said sheets are aligned at their lower ends.

9. A sheet receiver as defined in claim 7, wherein said upturned wall has a clearance space for said portion of said stapler which displaces a set of sheets, and said tray has a notch at said clearance space in which a corner of said sets of sheets are stapled.

10. A sheet receiver as defined in claim 7, wherein said upturned wall has a plurality of clearance spaces spaced laterally of the tray for said portion of said stapler which displaces a set of sheets, and said tray has a notch at each of said clearance spaces in which portions of said sets of sheets are stapled, and including means for horizontally shifting said stapler to each of said clearance spaces.

11. A sheet receiver as defined in claim 1, including support means for said trays operable upon operation of said cam means to maintain the trays successively in the same angular relation to said stapler during stapling operations.

* * * * *